US006024849A

United States Patent [19]

Ko

[11] Patent Number: 6,024,849

[45] Date of Patent: Feb. 15, 2000

[54] CONDUCTING ROLLER FOR AN ELECTROPLATING APPARATUS

[76] Inventor: Chien-Hsin Ko, No. 7, Sec. 2, Chung-She Rd., Shih-Lin Dist., Taipei City, Taiwan

[21] Appl. No.: 09/137,547

[22] Filed: Aug. 20, 1998

[30] Foreign Application Priority Data

May 6, 1998 [TW] Taiwan ..... 87207024

[51] Int. Cl.[7] ..... C25D 17/00

[52] U.S. Cl. ..... 204/279

[58] Field of Search ..... 204/279, 204

[56] References Cited

U.S. PATENT DOCUMENTS 4,986,888 1/1991 Hosten et al. ..... 204/198
5,164,059 11/1992 Geiermann et al. ..... 204/279 X

FOREIGN PATENT DOCUMENTS 701571 12/1953 United Kingdom .

*Primary Examiner*—Donald R. Valentine
*Attorney, Agent, or Firm*—Christie, Parker & Hale, LLP

[57] ABSTRACT

A conducting roller for an electroplating apparatus, includes: a conductive shaft having one end for making an electrical connection; a rotatable conductive sleeve provided coaxially around the conductive shaft with an annular space formed between the conductive shaft and the conductive sleeve; a plurality of rollable conductive elements disposed in the annular space; a rotatable first closure member which closes one end of the annular space, the first closure member being connected to the conductive shaft in a rotatable relationship and fixed to the conductive sleeve for simultaneous rotation; a drive member drivingly sleeved on the first closure member; a rotatable second closure member which closes another end of the annular space, the second closure member being connected to the conductive sleeve for simultaneous rotation and rotatably sleeved around the conductive shaft; and a tubular cover provided around the second closure member and fixed immovably to the conductive shaft.

4 Claims, 3 Drawing Sheets

CONDUCTING ROLLER FOR AN ELECTROPLATING APPARATUS

BACKGROUND OF THE INVENTION

1. Field of the Invention

The present invention relates to an electroplating apparatus, more particularly to the construction of a conducting roller used in an electroplating apparatus.

2. Brief Description of the Related Art

It is known to use conducting rollers in an electroplating apparatus in which plate-shaped objects are fed horizontally through an electroplating bath by rollers. Examples of such electroplating apparatuses are disclosed in U.S. Pat. No. 4,986,888 and British Patent No. 701,571. In such apparatuses, the conducting rollers are usually connected to a negative side of a power source so that the objects act as cathodes when passing between pairs of the conducting rollers. Anodes are disposed above and below the path of the objects in the electroplating bath which contains an electrolyte, whereby the objects are plated while passing through the electroplating bath. In order to obtain satisfactory plated objects, forming a good electrical connection in conducting rollers is important.

SUMMARY OF THE INVENTION

An object of the invention is to provide a conducting roller of improved construction for an electroplating apparatus of the type discussed above.

According to the present invention, a conducting roller for an electroplating apparatus, comprises:

- a stationary conductive shaft having one end for making an electrical connection and another end opposite to said one end;
- a rotatable conductive sleeve provided coaxially around the conductive shaft with an annular space formed between the conductive shaft and the conductive sleeve;
- a plurality of rollable conductive elements disposed in the annular space to establish an electrical connection between the conductive shaft and the conductive sleeve;
- a rotatable first closure member which closes one end of the annular space, the first closure member having one end connected to another end of the conductive shaft in a rotatable relationship and fixed to the conductive sleeve for simultaneous rotation;
- a drive member drivingly sleeved on the first closure member;
- a rotatable second closure member which closes another end of the annular space, the second closure member being connected to the conductive sleeve for simultaneous rotation and rotatably sleeved around the conductive shaft to confine the rollable conductive elements in the annular space; and
- a tubular cover provided around the second closure member and fixed immovably to the conductive shaft adjacent to one end of the conductive shaft.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
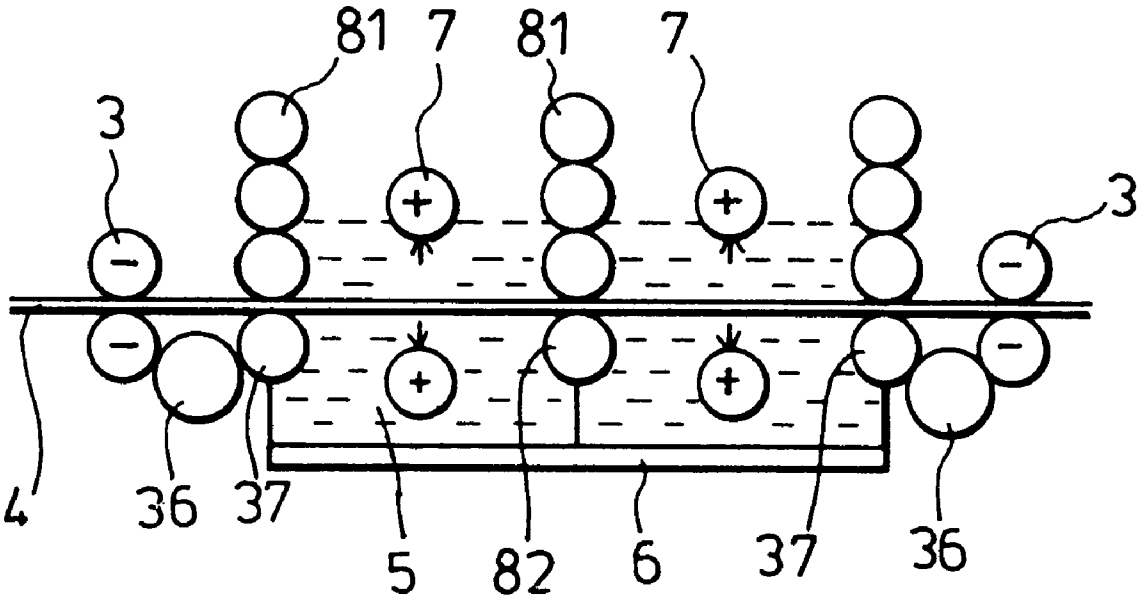
FIG. 1 is a schematic view showing an electroplating apparatus incorporating the present invention.

Referring to FIG. 1, an electroplating apparatus which incorporates the present invention is shown to include pairs of conducting rollers 3 disposed at upstream and downstream sides of an electroplating bath 6 which contains an electrolyte 5. A plurality of spray tubes 7 and rollers 36, 37, 81 and 82 are provided inside the electroplating bath 6. The spray tubes 7 not only function as anodes as they are electrically connected to a power source, but also spray an electrolyte onto an object. The rollers include upper rollers 81, and lower rollers 36, 37, 82 to advance the plate-shaped object 4 through the electroplating bath 6. The upper rollers 81 are arranged such that they will move downward by gravity to place the lowermost upper roller 81 in contact with the corresponding lower rollers 37, 82 as soon as the object 4 moves past the inlet and outlet of the electroplating bath 6, thereby sealing the inlet and outlet and preventing the electrolyte from leaking and from staining the conducting rollers 3 provided outwardly of the electroplating bath 6.

Figure 2:
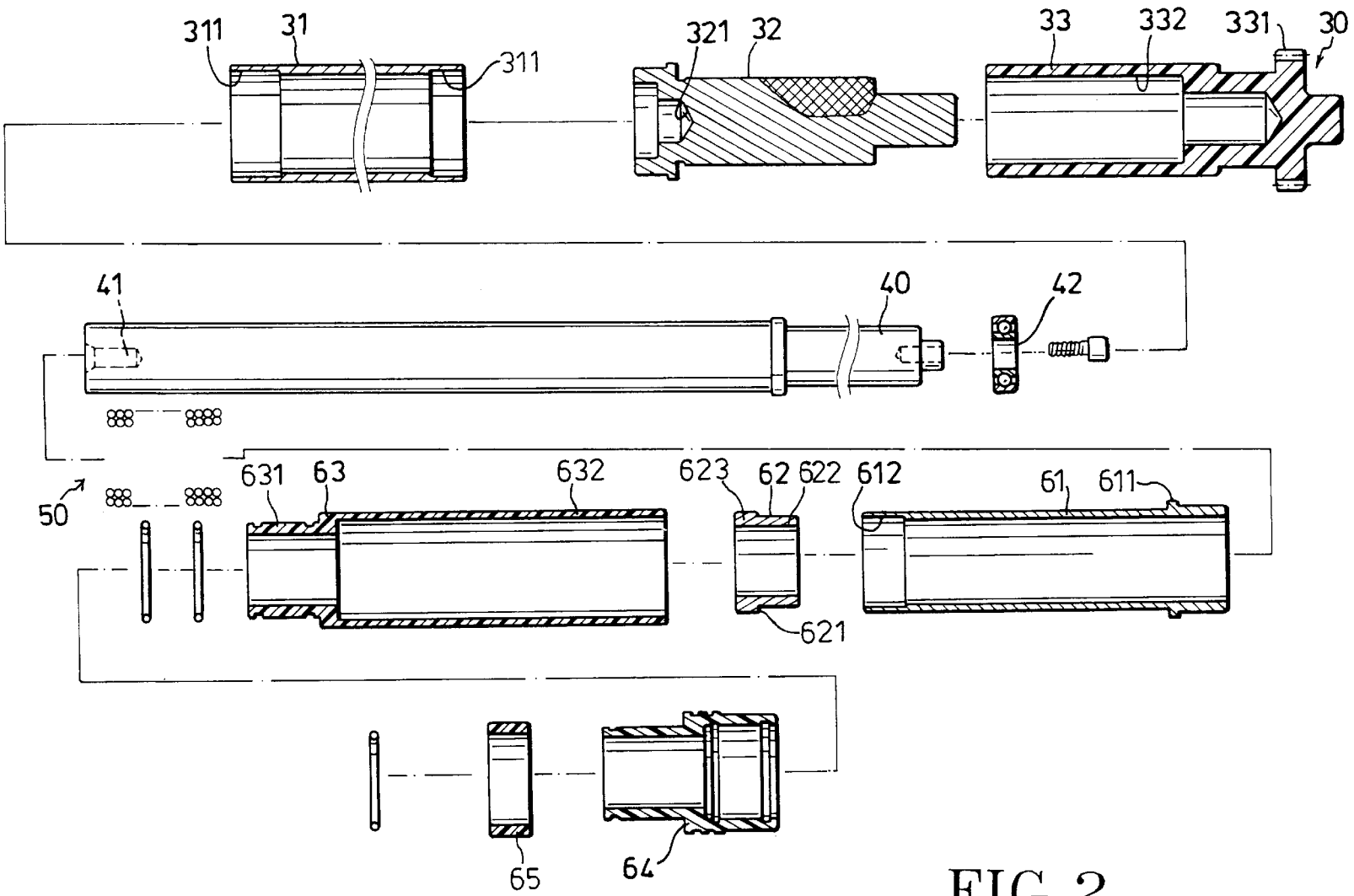
FIG. 2 is an exploded view of a conducting roller embodying the present invention.
Figure 3:
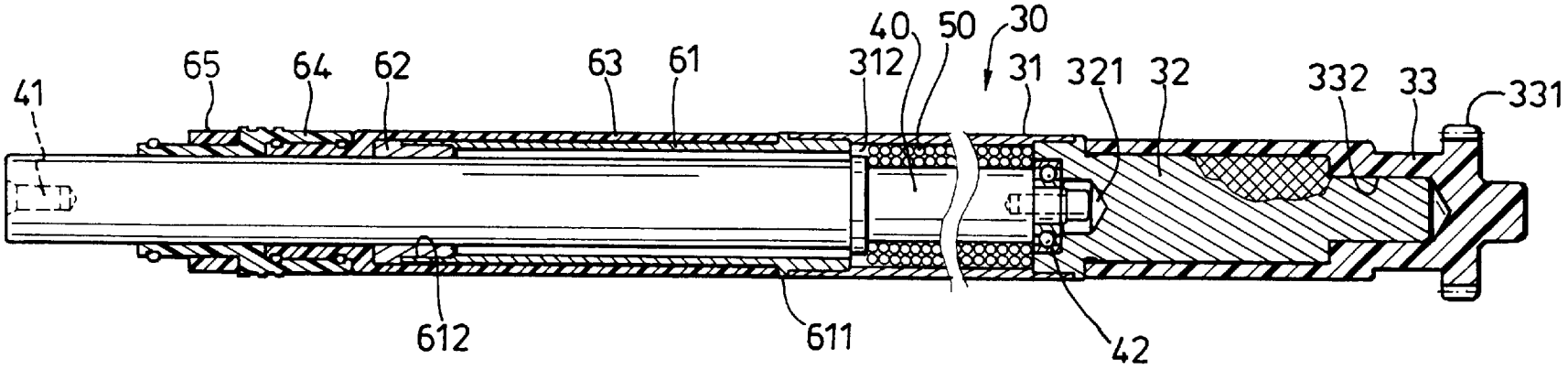
FIG. 3 is a sectional view of the conducting roller of FIG. 2.

As shown in FIGS. 2 and 3, each conducting roller 3 includes a rotatable conductive unit 30, a stationary conductive shaft 40 and rollable conductive solid elements 50 provided between the stationary conductive shaft 40 and the rotatable conductive unit 30.

The stationary conductive shaft 40 has one end with a connecting part 41 for electrical connection with a negative side of a power source, and another end fitted in a first annular bearing member 42. The conductive shaft 40 is preferably made of red brass.

The rotatable conductive unit 30 includes a conductive sleeve 31 provided coaxially around a portion of the conductive shaft 40. The conductive sleeve 31 has two opposite enlarged hollow ends 311 at two ends thereof. An annular space 312 is formed between the conductive shaft 40 and the conductive sleeve 31 to receive rollable solid conductive elements 50 to thereby establish an electrical connection between the conductive shaft 40 and the conductive sleeve 31. The rollable solid conductive elements 50 are preferably made of gold, silver, copper or graphite and constructed as balls.

A first closure member 32 is connected to the conductive shaft 40 through the first annular bearing member 42 so that the first closure member 32 is rotatable relative to the conductive shaft 40. The first closure member 32 extends into the adjacent enlarged hollow end 311 of the conductive sleeve 31, thereby closing one end of the annular space 312. The first closure member 32 has a recess 321 to fittingly receive the first annular bearing member 42. The conductive sleeve 31 is welded to the first closure member 32 for integral connection and for simultaneous rotation.

A drive member 33 is a hollow body provided with a bore 332 to fittingly receive the first closure member 32 so that the drive member 33 can rotate the first closure member 32. The drive member is made of plastics, such as PVC.

A second closure member 61 is provided to close another end of the annular space 312. The second closure member 61 is rotatably mounted on the conductive shaft 40 with a clearance therebetween and extends into the adjacent enlarged hollow end 311 of the conductive sleeve 31 to be welded thereat, thereby closing the annular space 312 and confining the rollable solid conductive elements 50 in the annular space 312. An annular projection 611 formed on the second closure member 61 engages the end of the conductive sleeve 31.

A stationary tubular cover 63 is disposed around the second closure member 61 and fixed to the conductive shaft 40 adjacent to the connecting part 41. The tubular cover 63 is preferably made of plastics, such as PVC. The tubular cover 63 has a first section 631 of constricted cross-section and a second section 632 of enlarged cross-section. The first section 631 is fixed in contact with the peripheral surface of the conductive shaft 40 adjacent to the connecting part 41 thereof. The second section 632 forms an annular gap with the conductive shaft 40 to receive the second closure member 61.

A second annular bearing member 62 is disposed in the annular gap of the second section 632 of the tubular cover 63 adjacent the first section 631. The second annular bearing member 62 is in contact with the peripheral surface of the conductive shaft and supports the second closure member 61 spacedly from the conductive shaft 40. The second closure member 61 further has an indented inner surface 612 to be in contact with the second annular bearing member 62. The second annular bearing member 62 is preferably made of a metallic bearing material and has a stepped construction formed with an annular shoulder 621 between two sections 622 and 623. The section 622 contacts the inner surface of the second closure member 61 whereas the section 623 is in contact with the inner surface of the tubular cover 63. Numerals 64 and 65 respectively designate a protective sleeve and a fixing ring.

In assembly, the first closure member 32 is coupled with the conductive sleeve 31 by welding and fitted in the bore 332 of the drive member 33. Then, the conductive shaft 40 is inserted into the recess 321 of the first closure member 32 from the open end of the conductive sleeve 31, thereby mounting the first annular bearing member 42 inside the first closure member 32. Afterwards, the conductive solid elements 50 are placed in the annular space 312 between the conductive sleeve 31 and the conductive shaft 40. The annular space 312 is closed by the second closure member 61, and the second annular bearing member 62 is inserted between the conductive shaft 40 and the second closure member 61. Finally, the tubular cover 63 is sleeved around the second closure member 61 and fixed to the conductive shaft 40.

In operation, the conductive sleeve 31 is rotated together with the first and second closure members 32 and 61 via the drive member 33 which has a transmission gear 331. With the rollable solid conductive elements 50 between the conductive sleeve 31 and shaft 40, a good electrical conduction is achieved in the conducting roller according to the present invention.

With the invention thus explained, it is apparent that various modifications and variations can be made without departing from the spirit of the present invention. It is therefore intended that the invention be limited only as indicated in the appended claims.

What I claim is:

1. A conducting roller for an electroplating apparatus, comprising:

a stationary conductive shaft having one end for making an electrical connection and another end opposite to said one end;

a rotatable conductive sleeve provided coaxially around said conductive shaft with an annular space formed between said conductive shaft and said conductive sleeve;

a plurality of rollable conductive elements disposed in said annular space to establish an electrical connection between said conductive shaft and said conductive sleeve;

a rotatable first closure member which closes one end of said annular space, said first closure member having one end connected to said another end of said conductive shaft in a rotatable relationship and fixed to said conductive sleeve for simultaneous rotation;

a drive member drivingly sleeved on said first closure member;

a rotatable second closure member which closes another end of said annular space, said second closure member being connected to said conductive sleeve for simultaneous rotation and rotatably sleeved around said conductive shaft to confine said rollable conductive elements in said annular space; and a tubular cover provided around said second closure member and fixed immovably to said conductive shaft adjacent said one end of said conductive shaft.

2. The conducting roller according to claim 1, further comprising a first annular bearing member between said another end of said conductive shaft and said first closure member, said first annular bearing member being disposed around said another end of said conductive shaft, said first closure member having a recess which fittingly receives said first annular bearing member.

3. The conducting roller according to claim 2, wherein said tubular cover has a first section of constricted cross-section and a second section of enlarged cross-section, said first section being in contact with a peripheral surface of said conductive shaft adjacent to said one end of said conductive shaft, said second section forming an annular gap with said conductive shaft to receive said second closure member.

4. The conducting roller according to claim 3, further comprising a second annular bearing member disposed in said annular gap around said conductive shaft adjacent said first section of said tubular cover, said second annular bearing member being in contact with a peripheral surface of said conductive shaft and having a portion extending in between said conductive shaft and said second closure member, thereby supporting said second closure member spacedly from the peripheral surface of said conductive shaft.

* * * * *